US005259683A

United States Patent [19]

Lubbe

[11] Patent Number: 5,259,683

[45] Date of Patent: Nov. 9, 1993

[54] PAPER BINDER

[76] Inventor: Petrus J. Lubbe, 5 Hohenort Avenue, Constantia, Cape Province, South Africa

[21] Appl. No.: 963,841

[22] Filed: Oct. 20, 1992

[30] Foreign Application Priority Data

Oct. 23, 1991 [ZA] South Africa ..... 91/8447

[51] Int. Cl.[5] ..... B42F 3/00

[52] U.S. Cl. ..... 402/68; 402/60; 281/21.1

[58] Field of Search ..... 402/62, 63, 68, 69, 402/60.64; 281/15.1, 21.1, 36, 37

[56] References Cited

U.S. PATENT DOCUMENTS 1,734,898 11/1929 Conrad ..... 402/69
2,197,071 4/1940 Cooper ..... 129/4
2,472,898 6/1949 Hazel, Jr. ..... 402/69
3,752,504 8/1973 Dixon ..... 402/69 X
4,984,925 1/1991 Chen ..... 402/69

*Primary Examiner*—Mark Rosenbaum
*Assistant Examiner*—Willmon Fridie, Jr.
*Attorney, Agent, or Firm*—Darby & Darby

[57] ABSTRACT

This invention concerns a paper binder which will enable papers bound therein to be paged in a manner similar to those of a bound book and is made up of a spine member with an adjustable clamping device for holding a bundle of papers against the spine member and a pair of cover connector plates hingedly connected to each side of the spine member with the clamping device in the form of a pair of clamping plates with a pair of flexible elements to thread through a bundle of perforated papers to tie the plates together with the papers securely held between the plates.

7 Claims, 3 Drawing Sheets

PAPER BINDER

INTRODUCTION

This invention relates to an adjustable paper binder assembly having a spine and a hinged cover connector to hold papers together on the spine in a booklike form. The assembly will allow the reader substantially the same flexibility and easy reading as a conventionally bound book.

BACKGROUND TO THE INVENTION

Desirable characteristics of covers for loose leaf papers are an ability to hinge or bend continuously at the spine without breaking and to accept normal printing inks for printing of titles and cover illustrations thereon.

There are many inexpensive materials available which will allow excellent printing of titles and cover illustrations and will be ideally suited for flat covers. However many of these cannot be used as covers as they do not have the ability to be continuously flexed or bent in one place without breaking. This is particularly true of paper- and paper-based products which are conventionally used as covers for paper binders.

The flexible outer covers that are available at present are normally made from expensive materials or the products of special combinations obtained from welding or adhesively securing polyvinylchloride and paper together. These materials usually require special printing processes such as silkscreening to have information displayed thereon. They are expensive.

To the applicant's knowledge there is no device available to act as an independent cover hinge to which various inexpensive flat materials can be attached to form ideal outer covers.

Binders for holding papers are well known and have been made to varying degrees of sophistication. In the simplest form the papers forming the contents of the binder are bound flat against the inside of the back cover and tied down with a flat metal or similar strip. The use of this type of binder makes it difficult to fold the pages for reading.

In ring binders the metal rings are fixed to the spine but the wear and tear of the contents is high. The punched holes in the paper cannot stand up to the rigours of the continuous pulling and jerking while turning the pages individually over the metal, or similar ring. Also the edges of all the pages must follow the shape of the ring in the closed binder.

SUMMARY OF THE INVENTION

According to this invention there is provided a paper binder comprising a spine member with an adjustable clamping device for holding a bundle of papers against the spine member and a pair of cover connector plates hingedly connected to each side of the spine member, the clamping device having a pair of clamping plates, one clamping plate being hinged to the spine member and the other slideable on the spine member between the cover connector plates.

Another feature of this invention provides for there to be a pair of flexible elements to thread through a bundle of suitably perforated papers to tie, in use, the plates together and hold the papers between the plates.

A further feature of this invention provides for the hinged clamping plate to be the operatively upper plate and the slidable clamping plate to be the operatively lower plate to allow, in use, for the bundle of perforated papers to be clamped towards the operatively upper plate.

Still further features of this invention provide for the cover connector plates to be shaped to receive the edges of cover sheets and for these sheets to be secured to the plates by securing strips having studs engageable in the cover plates and shaped to accommodate cover sheets of different thicknesses.

The invention also provides for the spine member to be rigid and interchangeable to accommodate different volumes of sheets and for the hinged clamping plate to include anchoring means for the flexible elements.

BRIEF DESCRIPTION OF THE DRAWINGS

These and other features of this invention will become apparent from the following description of a preferred embodiment of the invention wherein reference is made to the accompanying drawings in which.

DETAILED DESCRIPTION OF THE DRAWINGS

Figure 1:
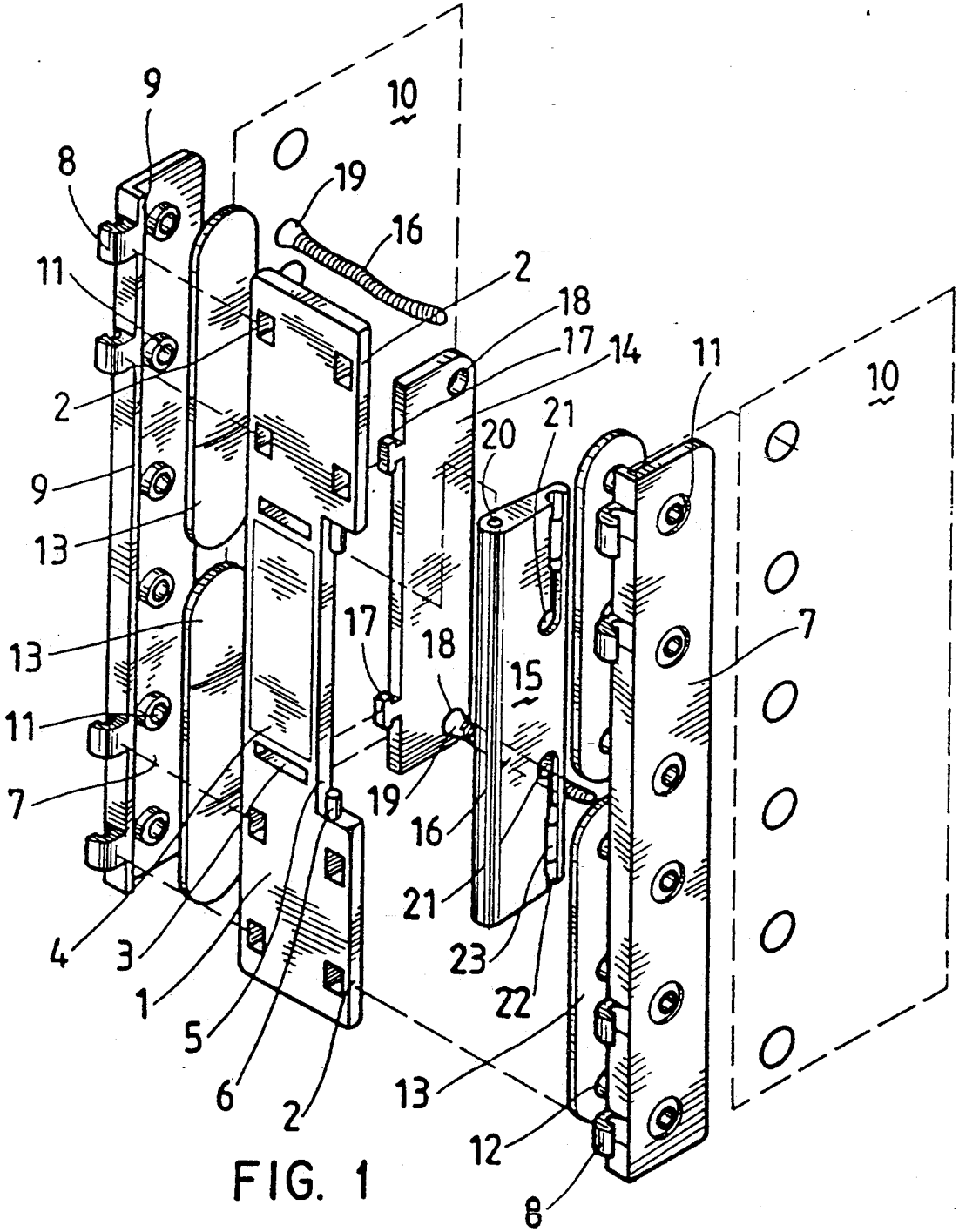
FIG. 1 is an exploded view of a paper binder.

Referring to FIG. 1 the binder consists essentially of a member forming a spine (1) of moulded suitably rigid plastics material. The spine (1) is flat and has a depth and width available for the size and maximum number of sheets to be bound.

Journals (2) are formed in pairs to extend parallel to the height of the spine adjacent each corner thereof and a pair of slots (3) spaced apart in the depth of the spine extend through the spine and across the major portion of the width thereof. Provision may be made as indicated at (4) for labelling of the binder.

One longitudinal edge of the spine (1) is recessed at (5) and a pair of pintles (6) project inwardly towards each other from each end of the recess.

Cover connector plates (7) are provided to be hingedly attached to each side of the spine (1).

Each plate has moulded hinge members (8) adjacent each end and adapted to resiliently engage around each of the journals (2) on the spine. The hinge members (8) extend from the cover plate (7) to form shoulders (9) against which the edge of a cover sheet indicated at (10) can be located.

Holes (11) are formed through the cover connector plates (7) to co-operate with resilient studs (12) projecting from securing strips (13). The cover sheets (10) will be correspondingly perforated to permit the studs (12) passing therethrough and enable the cover sheet to be clamped between the cover connector plates (7) and the securing strips (13). It should be noted that these strips are slightly resiliently concave to allow for different thicknesses of cover sheet material.

With cover sheets (10) secured as above described and the cover connector plates (7) hingedly connected to the spine (1) the covers can be folded around the journals (2).

The clamping device for holding the papers in the binder consists essentially of two clamping plates (14) and (15) and resilient tying elements (16).

One clamping plate (14), located in an operatively lower position, has studs (17) projecting from one edge. These studs are of T-shape and adapted on manipulation of the plate to be inserted through the slots (3) through the spine (1) and be resiliently retained in position. The clamping plate 14 is therefore slidable on the spine 1.

Adjacent the corners of the edge opposite the edge carrying studs (17) are a pair of holes (18) to permit the passage of the flexible elements (16) used to locate the pages in the binder as described below. The elements (16) will preferably have resilient heads (19) which will locate and releasably secure the elements (16) to the plate (14).

The second clamping plate (15), located in an operatively upper position, has longitudinal sockets (20) extending from the ends of the plate adjacent one edge. The plate can be flexed to enable the pintles (6) on the spine (1) to engage in the sockets (20) to hingedly attach the plate (15) to the spine (1).

Adjacent the opposite edge of the clamping plate to the sockets (20) are a pair of transverse holes (21) spaced inwardly from the top and bottom corners. These holes enable the elements (16) to pass therethrough and be folded down into retaining slots (22) extending from the holes (21) towards the ends of the plate. Slide elements (23) will be provided to project into the slots (22) to anchor the ends of the flexible elements folded into the slots (22).

Read with FIG. 1, FIGS. 2A to 2F illustrate the assembly of the binder and how pages are loaded therein. The clamping plates (14) and (15) are positioned on the spine (1) and the covers consisting of cover sheets (10), cover plates and securing strips also hingedly attached to the spine.

Loading of the papers is effected by swinging the top cover into the open position and rotating the top clamping plate (15) to extend above the spine (1). Perforated pages (24) can then be threaded onto the elements (16).

Figure 2A:
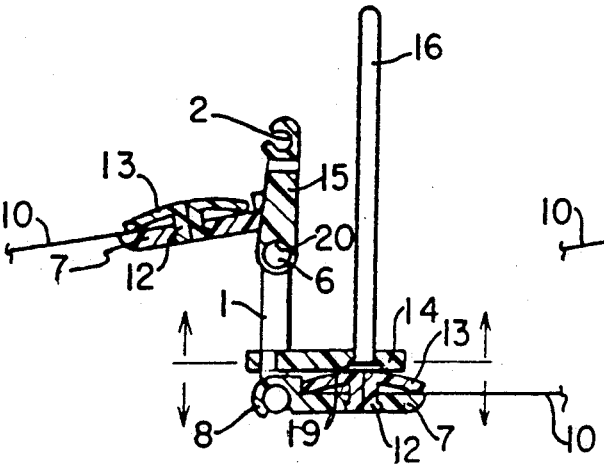
FIGS. 2A–2F illustrate the loading of pages into the binder.
Figure 2B:
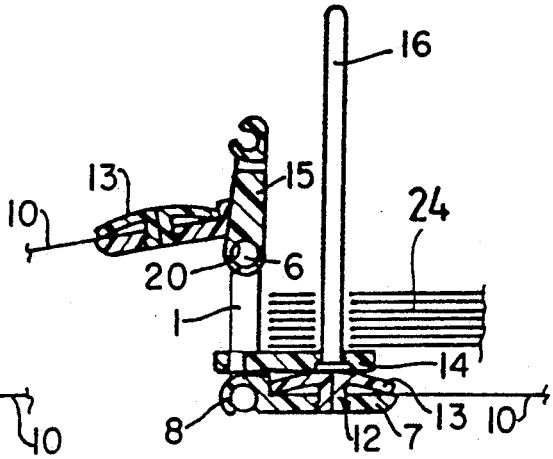
Figure 2C:
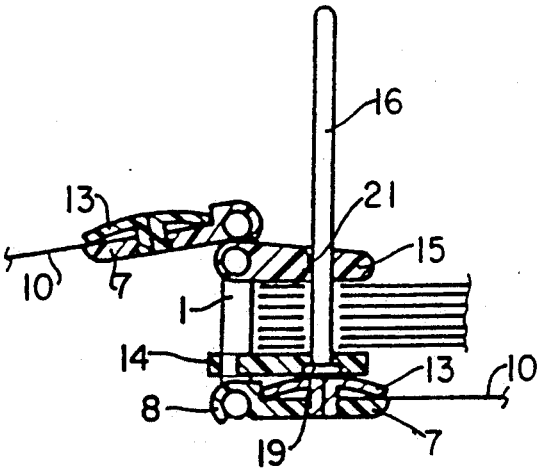
Figure 2D:
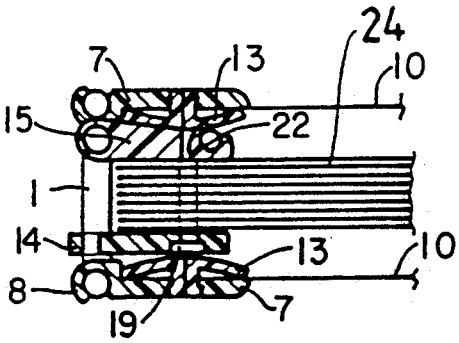
Figure 2E:
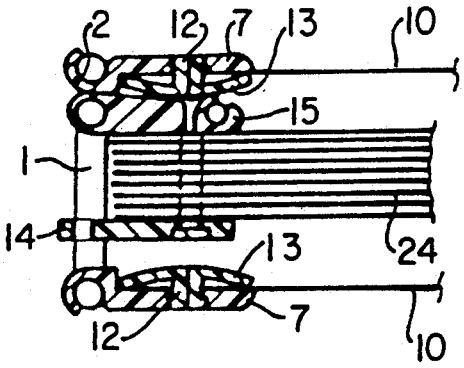
Figure 2F:
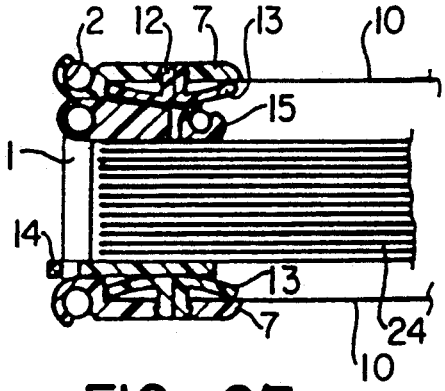

The clamping plate (15) can then be swung back into position and the elements (16) threaded through holes (21) drawn up taut and locked in the slots (22).

Where the binder is not filled the drawing up of the elements will cause the clamping plate (14) to move across the spine (1) as indicated in FIG. 2E. The papers are therefore clamped against the operatively upper hinged plate 14 which allows for easy paging of the papers in the file.

Figure 3A:
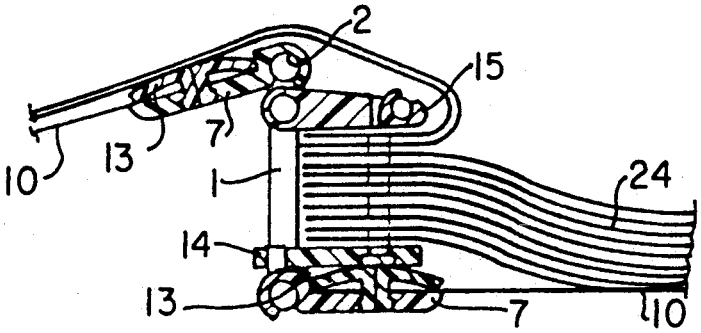
FIGS. 3A–3C illustrate the binder in use.
Figure 3B:
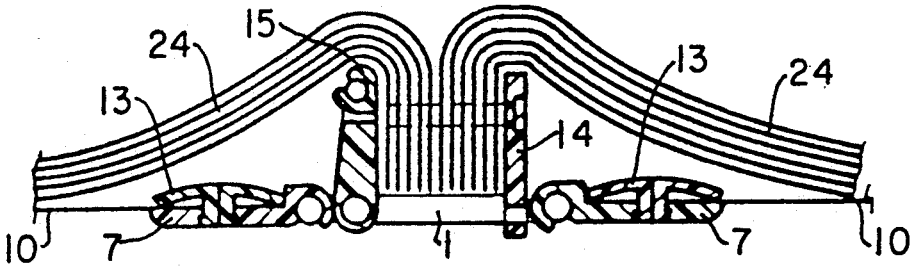
Figure 3C:
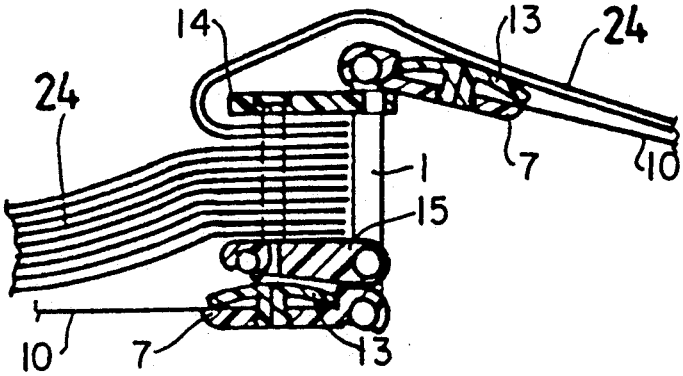

FIGS. 3A-3C shows how the binder acts in a manner similar to a book.

The covers are easily foldable relative to the spine and the contents are bound without any danger of damage to the loose pages.

The binder assembly enables the pages to be easily folded or paged, either individually or in batches onto the front cover. When the cover unit is opened it enables the spine to face the larger bundle of papers as is the case with a properly bound book.

The bound paper contents can be tilted in an upright, or any other, position (like the bound pages of a book) whilst the covers remain opened flat. Paging, reading or writing are consequently made easy. Conveniently all of the components can be made of the same plastics material but the flexible elements may be made of other suitable material.

As the cover sheets 10 are connected to cover plates 7 which are pivotally mounted to the spine 1, the cover sheets 10 can be made of material which does not have to be bendable. A hard plastics material or a cover made of cardboard similar to a conventional hard cover book may be used.

What I claim as new and desire to secure by letters patent is:

1. A paper binder comprising a longitudinally extending spine member with an adjustable clamping device for holding a bundle of papers against the spine member and a pair of cover connector plates hingedly connected to the longitudinal outer ends of the spine member, the clamping device having a pair of clamping plates, one clamping plate is hinged to the spine member between the cover connector plates and the other slidable on the spine member between the cover connector plates.

2. A paper binder as claimed in claim 1 in which there is a pair of flexible elements to thread through a bundle of suitably perforated papers to tie, in use, the clamping plates together and hold the papers between the clamping plates.

3. A paper binder as claimed in claim 1 in which the hinged clamping plate is the operatively upper clamping plate and the slidable clamping plate is the operatively lower clamping plate to allow, in use, for the bundle of perforated papers to be clamped towards the operatively upper clamping plate.

4. A paper binder as claimed in claim 1 in which the cover connector plates are shaped to receive the edges of cover sheets.

5. A paper binder as claimed in claim 4 in which the cover sheets are secured to the cover connector plates by securing strips having studs engageable in the cover connector plates and shaped to accommodate cover sheets of different thicknesses.

6. A paper binder as claimed in claim 1 in which the spine member is rigid and interchangeable to accommodate different volumes of sheets.

7. A paper binder as claimed in claim 2 in which the hinged clamping plate includes anchoring means for the flexible elements.

* * * * *